US009453315B2

(12) United States Patent
Roy

(10) Patent No.: US 9,453,315 B2
(45) Date of Patent: Sep. 27, 2016

(54) HYDROSTATIC FLUID CONTAINMENT SYSTEM

(71) Applicant: Scott Roy, Parrearra (AU)

(72) Inventor: Scott Roy, Parrearra (AU)

(73) Assignee: Scott Roy, Parrearra, QLD (AU)

( * ) Notice: Subject to any disclaimer, the term of this patent is extended or adjusted under 35 U.S.C. 154(b) by 0 days.

(21) Appl. No.: 14/902,550

(22) PCT Filed: Feb. 10, 2015

(86) PCT No.: PCT/AU2015/050048
§ 371 (c)(1),
(2) Date: Dec. 31, 2015

(87) PCT Pub. No.: WO2015/120516
PCT Pub. Date: Aug. 20, 2015

(65) Prior Publication Data

US 2016/0201281 A1 Jul. 14, 2016

(30) Foreign Application Priority Data

Feb. 11, 2014 (AU) ..... 2014900400

(51) Int. Cl.
*E02B 7/26* (2006.01)
*E02B 3/10* (2006.01)

(52) U.S. Cl.
CPC ..... *E02B 3/104* (2013.01); *E02B 3/102* (2013.01)

(58) Field of Classification Search
CPC ..... E02B 7/24; E02B 7/56; E02B 3/104
See application file for complete search history.

(56) References Cited

U.S. PATENT DOCUMENTS

| | | | | |
|---|---|---|---|---|
| 5,460,462 | A | 10/1995 | Regan | |
| 5,725,326 | A * | 3/1998 | Van den Noort | E02B 3/104 405/103 |
| 7,744,310 | B2 * | 6/2010 | Alpern | E02B 3/104 405/103 |
| 2011/0110722 | A1 * | 5/2011 | van den Noort | E02B 3/104 405/87 |
| 2015/0117952 | A1 * | 4/2015 | Gujer | E02B 3/104 405/96 |

FOREIGN PATENT DOCUMENTS

| | | |
|---|---|---|
| FR | 2846014 A1 | 4/2004 |
| GB | 2464959 A | 5/2010 |
| NL | 2000546 C2 | 9/2008 |
| WO | WO 2012/084783 A1 | 6/2012 |

* cited by examiner

*Primary Examiner* — John Kreck

(57) ABSTRACT

A hydrostatic fluid containment system, or flood barrier, that is positioned underground in its open state consisting of a buoyant wall which floats up and above ground level when submerged in a fluid, creating a seal from both buoyant vertical and hydrostatic horizontal forces on the containment wall imposed by the contained fluid. The system will not open prematurely and restrict access of vehicles or pedestrians until containment is necessary. The system comprises a pivot seal which seals the barrier on the upstream side, as well as another sealing element that is positioned between the pivot seal and the buoyant wall. The pivot helps to tilt the barrier towards the upstream direction.

22 Claims, 9 Drawing Sheets

HYDROSTATIC FLUID CONTAINMENT SYSTEM

BACKGROUND OF THE INVENTION

Loss of income due to business closure, increased insurance premiums and decreased property values may be experienced after significant fluid damage such as tidal surges, stormwater runoff, burst water pipes or industrial spills. In events such as these members of the community are often left unprepared and under resourced.

Repair and replacement cost to property and infrastructure can be significant if effected by fluid damage during floods or industrial accidents. The time taken to clean up fluid damage may be increased due to access restrictions of property, equipment and machinery.

Permanent conventional flood barriers can restrict the movement of vehicles and pedestrians while temporary barriers such as sand bags and demountable walls may be in limited supply or difficult to access during emergencies.

In one example of a floating barrier a combination service and entry pit receives floodwater from a river or ground surface area. The floodwater gradually fills the service pit until the water is just below ground level then a riser pipe allows the flow to pass down the pipe and along an underground piping network that directs the floodwater to the base of channels that contain floating barriers. The barriers float up and above ground when enough water is received however this action occurs before floodwater is actually flowing across the ground surface thereby restricting vehicles and pedestrian traffic where they would normally be trying to get to a safe location before the actual flood water became a real risk.

Fluid containment systems can be installed at and not limited to river banks, esplanades, property boundaries, underground car park access points, infrastructure access points and agricultural flow channels.

Fluids entering a channel containing a floating barrier at ground level ensure the wall will only raise when fluids are flowing across the ground surface. Fluids entering a channel below the ground surface would raise a wall before surface fluid flows are encountered. Fluids raising a wall before surface fluid flows are encountered create an unnecessary restriction above ground level. Walls raising above ground level when surface fluid flows are not encountered restrict movement of pedestrians and vehicles.

Some of the less than desirable features of floating barriers include:

Fluid entry points below ground level which float the barrier before surface flows are a threat.

Even with risers inside of entry pits, the barriers still float before surfaces flows are actually at ground level which restricts vehicle and pedestrian traffic.

Fluid entry points below ground and connected directly to stormwater drainage networks will raise prematurely as the piping pressurizes under normal design flow.

Service and flow entry pits located away from the fluid interception zone therefore unable to intercept a point source.

Piping that transfers fluid from entry pits to interception channels interfere with existing underground services.

Entry pits require large areas of sealed surfaces to be removed and regraded to divert fluid flow.

Interconnecting pipework from entry pits to interception channels require deep trenching through existing sealed surfaces.

Support blocks which create pressure for the sealing mechanism are on the upstream flow side preventing entry grates to be installed at ground level in the channel interception zone.

Support blocks restrict access to the barrier during maintenance.

Guide frames for barrier seals interfere with barrier removal and require multiple calibrations points.

Guide frames don't apply even pressure across the length of the barrier seal.

Support blocks and pipe risers in entry pits restrict the ability to install filtration screens. Long continuous barriers deflect when tall and deep installations are required.

Barriers that retract horizontally into the ground can be damaged by vehicle traffic passing above.

These and other problems are reduced or eliminated by the invention disclosed herein.

SUMMARY OF THE INVENTION

In its broadest form a hydrostatic fluid containment system ensure upstream fluids flowing across the ground surface will be intercepted by a channel where vertical buoyant fluid forces act on a submerged wall raising it out of said channel restricting fluid flow and hydrostatic fluid forces from passing downstream beyond said channel.

In a further aspect of the invention said buoyant walls partially submerged in a fluid, located inside said channel, raise due to vertical hydrostatic forces as pressure acting below said wall are greater than the atmospheric forces acting above. The buoyant force has a magnitude equal and opposite to the weight of fluid displaced by said wall. Said channel would usually be positioned underground and able to receive surface fluid flows.

In a further aspect of the invention said wall with an unstable equilibrium centroid of displacement volume rotates the top of said wall towards contained fluid flows. The rotating wall equilibrium offsets vertical buoyant forces against horizontal hydrostatic forces from contained fluids on a pivot seal.

In a further aspect of the invention the rotating wall equilibrium is positioned on said pivot seal with a guide bracket which compresses said seal into a counter lever support frame. Vertical partitions in said wall create a bending moment shorter than that of a horizontal continuous beam reducing the deflection forces acting on said wall by the contained hydrostatic loads.

In a further aspect of the invention no components are required on the upstream side of said wall which can facilitate ground level open grates, filtration screens or baskets and convenient access of said seals for maintenance.

In a further aspect of the invention said buoyant wall will rise before the water level reaches said seals thereby keep maintenance requirements to a minimum and ensuring optimal operation.

In a further aspect of the invention said channel can be drained by a float activated pump, self-siphon with air break release valve or at grade to a downstream pipe network using a one way non return valve.

In a further aspect of the invention a vertical seal is located on each end of said wall where hydrostatic pressure is applied by the contained fluid against a vertical frame mounted on boundary retaining walls.

In a further aspect of the invention tension brackets are mounted on said boundary walls to prevent wave action from removing pressure from said vertical wall seal.

Embodiments of the invention will now be described in further detail with reference to, and as illustrated in the accompanying figures. These embodiments are illustrative and not intended to be restrictive of the scope of the invention.

BRIEF DESCRIPTION OF THE DRAWINGS

FIG. 1 depicts the hydrostatic fluid containment system apparatus 10 in the lowered open state constructed of impervious material such as concrete, steel or plastic. In this form the embodiment of the invention is located between boundary wall openings 11 in which rising water flows are to be intercepted from the upstream road, path or waterway 12 from entering the downstream dry zone 13. The buoyant wall 14 is in the open resting state where nearby water levels are below the removable inlet grates 15 and both vehicle and pedestrian traffic are unobstructed. Chamber 16 contains an angled bracket seal 17 connected to pivot seal 18 and pivot seal 18 connected to chamber wall 16 both constructed preferably from stainless steel or similar corrosive resistant material. The pivot seal 18 is used for sealing the buoyant wall in the horizontal and vertical direction. Buoyant wall 14 is fixed to a support beam 19 which displace top loads from traffic across the apparatus 10 and prevents vertical forces from being applied to buoyant wall 14 when in the lowered open position. Support beam 19 also restricts horizontal deflection loads applied by the contained fluid from deforming buoyant wall 14 when in the raised closed position. Buoyant wall base 20 is wider than buoyant wall 14 which facilitates pivot sealing guide 21 to align with angle seal bracket 17 and provides a seating bed for sealing rubber or appropriate flexible material 22 which will also align with pivot seal 18 when in the raised closed position. Buoyant base 20 dimensions can be calibrated to ensure equal and opposite mass displacement in order to raise varying height buoyant walls 14. Sealing rubber (or sealing element) 22 is attached to the downstream side of buoyant wall 14 in both horizontal and vertical faces of buoyant wall 14 to create a watertight seal on against pivot seal 18 in both horizontal and vertical directions. Wave tension brackets 23 and guide wall frame 24 are connected to boundary wall 11 which guide buoyant wall 14 when raising into the closed position. Hydrostatic forces imposed on buoyant wall 14 from the contained fluids in the upstream catchment zone 12 create a water sight seal when sealing rubber 22 is compressed against guide wall frame 24 when in the raised closed position. Wave tension brackets 23 compress buoyant wall 14 against wall frame 24 when in the upright closed position which create a watertight join on sealing rubber 22 to prevent fluid from entering downstream dry zone 13. Wave tension brackets 23 prevent waves on the upstream catchment side 12 from creating negative hydrostatic forces on buoyant wall 14 which may break the watertight connection on sealing rubbers 22. A float activated pump 25 transmits fluid from collection sump 26 to discharge drain 27 which can be directed back to the road, path or waterway 12 either upstream or downstream of apparatus 10. Float activated pump 25 ensures buoyant wall 14 rests at the bottom of chamber 16 when in the open state such as when the fluid levels to be contained subside or if small spills are intercepted. Float activation pump 25 prevents buoyant wall 14 from resting in the half open/closed state if incoming intercepted flows are less than the pump can displace from collection sump 26. Buoyant wall 14 comprises of vertical partitions 28 which act as vertical support beams to reduce vertical and horizontal bending moments on buoyant wall 14 applied from the contained hydrostatic forces in upstream catchment 12. Pivot sealing guide 21 and angled bracket seal 17 create a fixed point to which vertical partitions 28 are attached when buoyant wall 14 is in the raised closed position to prevent deflection of buoyant wall 14 as explained with more detail later in the specification. Angled bracket seal 17 and pivot sealing guide 21 could be constructed in a continuous section or in shorter individual modules spaced along the length of buoyant wall 14. Pivot seal 18 is connected to chamber 16 with fasteners 29 and angled bracket seal 17 is connected to pivot seal 18 with fasteners 30 which can be removed to access buoyant wall 14 and associated components during service or maintenance. Angled bracket seal 17 can be adjusted to obtain watertight alignment between pivot seal 18 sealing rubber 22 and buoyant wall 14.

FIG. 2 depicts the hydrostatic fluid containment system apparatus 10 in the open closed state described with greater detail later in the specification (water level not shown in FIG. 2 but depicted in FIG. 4, FIG. 5, FIG. 6, FIG. 7, FIG. 8 and FIG. 9). Fluid enters inlet grate 15 from upstream road, path or waterway 12 and settles in collection sump 26 where the fluid level rises in chamber 16 causing the buoyant wall base 20 to raise buoyant wall 14. As buoyant wall 14 raises it is positioned by pivot seal guide 21 and wall frame 24 until it reaches the angled seal bracket 17, sealing rubber 22 and pivot seal 18. Wave tension brackets 23 compress buoyant wall 14 against wall frame 24 when in the upright closed position. Vertical partitions 28 act as vertical support beams to reduce vertical and horizontal bending moments on buoyant wall 14. Pivot sealing guide 21 and angled bracket seal 17 create a fixed point to which vertical partitions 28 are attached when buoyant barrier 14 is in the raised closed position. Support beam 19 restricts horizontal deflection loads applied by the contained fluid from deforming buoyant wall 14 when in the raised closed position.

FIG. 3 depicts the hydrostatic fluid containment system apparatus 10 in the lowered open state where buoyant wall base 20 is located above collection sump 26 to prevent vertical compression forces acting on buoyant wall 14 applied by traffic on support beam 19. Support beam 19 displaces traffic loads across inlet 15 and pivot seal 18. Chamber 16 has an internal rebate below inlet grate 15 to allow the flow of fluids from upstream catchment 12. Sealing rubber 22 and pivot seal guides 21 are attached to buoyant wall 14. Pivot seal 18 is connected to chamber 16 with fastener 29 while angled bracket seal 17 is connected to pivot seal 18 with fastener 30 on the downstream dry zone 13.

FIG. 4 depicts the hydrostatic fluid containment system apparatus 10 in the partially raised closing state. Fluid from upstream catchment 12 has entered inlet grate 15 and started filling chamber 16. Fluid levels in collection sump 26 has risen to a point where the displacement mass of buoyant wall base 20 is greater than the total mass of buoyant wall 14. The configuration size of buoyant wall base 20 is in such a way that seal rubber 22 remains above rising fluid levels to restrict particles in suspension from being attached to rubber seal 22. Pivot sealing guide 21 follows the profile of chamber wall 16 as the unstable equilibrium centroid of displacement volume from buoyant wall base 20 rotates the top of buoyant wall 14 towards contained fluid in catchment 12. This rotation and positioning of pivot sealing guide 21 facilitates the interlocking connection between angled bracket seal 17 and pivot sealing guide 21 which ensures the correct mating of components.

FIG. 5 depicts the hydrostatic fluid containment system apparatus 10 in the raised closed state. Fluid has filled chamber 16 raising buoyant wall 14 to the fully closed position creating vertical hydrostatic forces on buoyant wall base 20 which compresses sealing rubber 22 between pivot seal 18. Pivot sealing guide 21 is connected with angle bracket seal 17 which has horizontally compressed sealing rubber 22 against pivot seal 18 due to the tapered shape of pivot sealing guide 21. Vertical forces from buoyant wall base 20 which pivot the top of buoyant wall 14 towards contained fluids on upstream catchment 12 are counteracted by horizontal hydrostatic forces from the contained fluid which pivot the top of buoyant wall 14 towards downstream dry zone 13. Vertical partitions 28 act as vertical support beams to reduce vertical and horizontal bending moments on buoyant wall 14. Pivot sealing guide 21 and angled bracket seal 17 create a fixed point to which vertical partitions 28 are attached when buoyant barrier 14 is in the raised closed position. Support beam 19 restricts horizontal deflection loads applied by the contained fluid from deforming buoyant wall 14 when in the raised closed position.

FIG. 6 depicts the hydrostatic fluid containment system apparatus 10 in the raised closed state detailing the boundary wall 11 sealing configuration. Sealing rubber 22 is compressed between buoyant wall 14 and guide wall frame 24 by horizontal hydrostatic forces from contained fluid in catchment 12. Tension brackets 23 prevent wave motion in the upstream catchment 12 from creating negative pressures on buoyant wall 14 and support bracket 19 which could allow fluid flows to the downstream dry zone 13. The float activated pump 25 non-return valve 31 on discharge drain 27 is in the closed position until the pump is activated when contained fluid in upstream catchment 12 subside.

FIG. 7 depicts the hydrostatic fluid containment system apparatus 10 in the raised closed state when contained fluid in catchment 12 has subsided. Float activated pump 25 conveys fluid through discharge drain 27 and past non-return valve 31 expelling fluid from chamber 16 to either upstream catchment 12 or downstream zone 13 depending on the existing drainage system surrounding the apparatus. Buoyant wall 14 lowers back into chamber 16 as depicted in FIG. 3 when the contained fluid is expelled by pumping means as described in FIG. 7 or siphon and gravity means as described in FIG. 8 and FIG. 9 respectively.

FIG. 8 depicts the hydrostatic fluid containment system apparatus 10 in the raised closed state when contained fluid in catchment 12 has subsided. A siphon tube 32 with attached air break and isolation valve can be attached to chamber 16 where the downstream dry zone 13 is lower than upstream catchment 12 such as underground car park installations. As fluid fills chamber 16 it also flows through siphon tube 32 which becomes self-primed by fitting an air break device and isolation valve to siphon tube 32. When the contained fluids subside at catchment 12 the isolation valve can be opened which will drain chamber 16 of fluid and lower buoyant wall 14 to its open resting state as depicted in FIG. 3.

FIG. 9 depicts the hydrostatic fluid containment system apparatus 10 in the raised closed state when contained fluid in catchment 12 has subsided. A gravity discharge drain 27 can be used to expel fluid from chamber 16 and fitted with a non-return valve 31 when the upstream catchment 12 fluid levels subside lower than catchment sump 26 such as a river, waterway or esplanade installation.

FIG. 10 depicts the hydrostatic fluid containment system apparatus 10 in the lowered open state showing design flexibility by not requiring any support structures on the upstream catchment 12 side of the device. The internal taper on rebate chamber 16 may be increased so a filtration screen 33 can be installed to prevent water borne pollutants from entering collection sump 26.

FIG. 11 depicts the hydrostatic fluid containment system apparatus 10 in the lowered open state showing design flexibility by not requiring any support structures on the upstream catchment 12 side of the device. The distance between buoyant wall 14 and the internal upstream wall on Chamber 16 may be increased so a filtration basket 34 can be installed and retain large volumes of water borne pollutants from entering collection sump 26.

FIG. 12 depicts the hydrostatic fluid containment system apparatus 10 in the lowered open state showing design flexibility by not requiring any support structures on the upstream catchment 12 side of the device. Chamber 16 can be completely removed from the upstream side of the apparatus when installed on a river, walkway or esplanade as all of the components required for operation are mounted on the downstream dry zone 13 of the installation.

DETAILED DESCRIPTION AND BEST MODE OF IMPLEMENTATION

Figure 1:
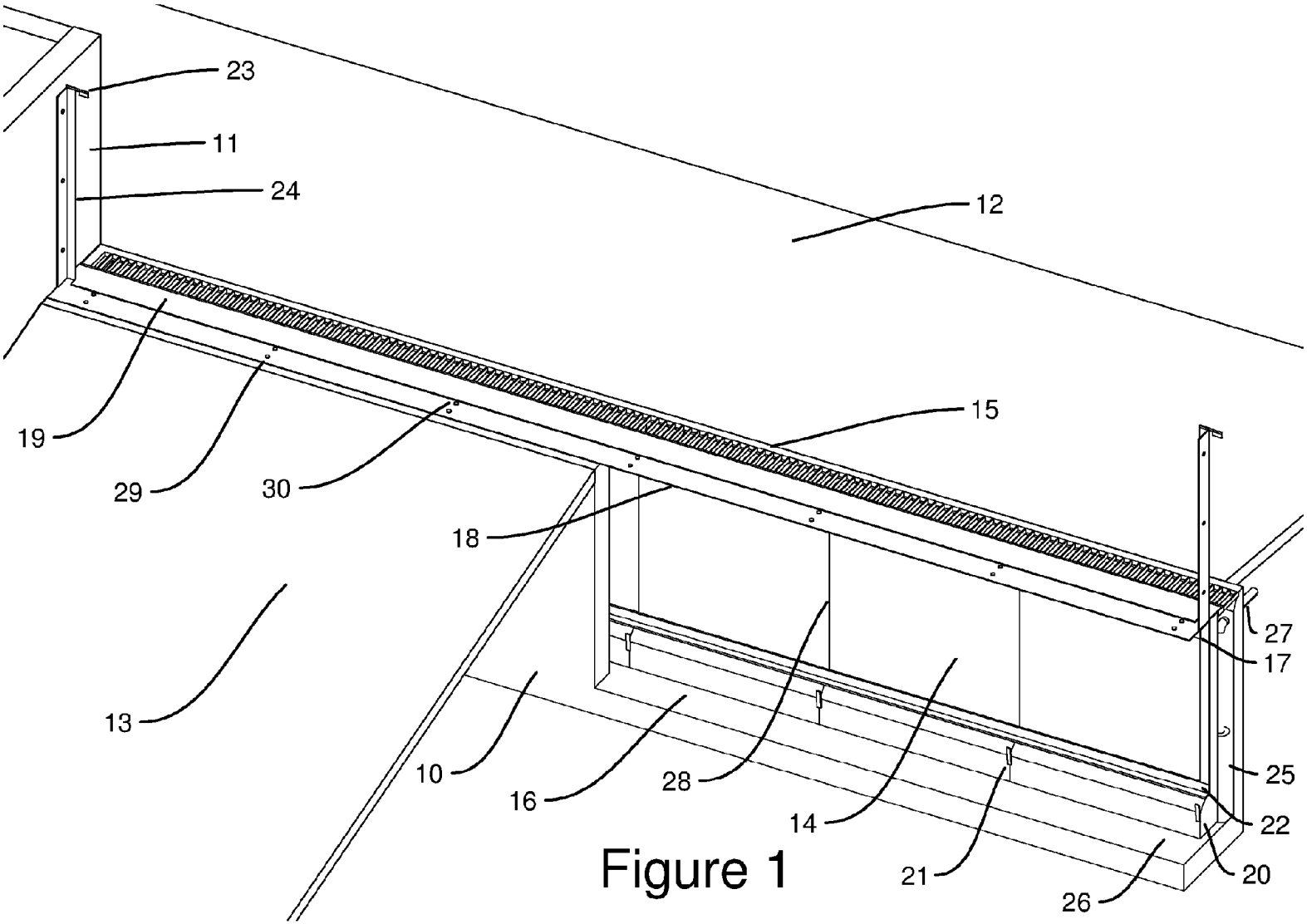
FIG. 1 depicts a perspective top view of a partial breakaway of an embodiment of the hydrostatic fluid containment system in place between the boundary wall flow interception zone of an underground car park and in the open resting state.
Figure 2:
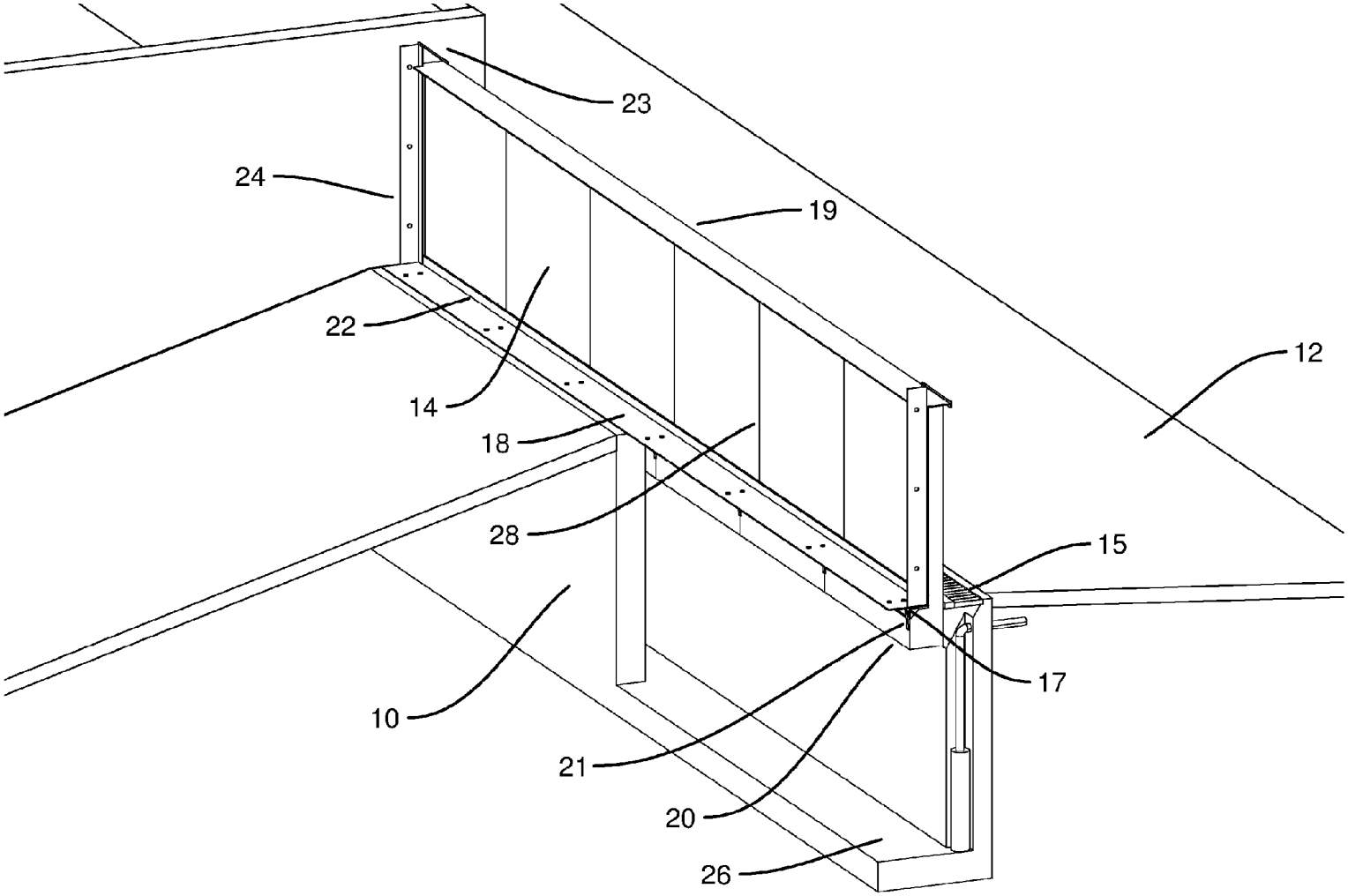
FIG. 2 depicts a perspective top view of a partial breakaway of an embodiment of the hydrostatic fluid containment system in place between the boundary wall flow interception zone of an underground car park and in the closed resting state.
Figure 3:
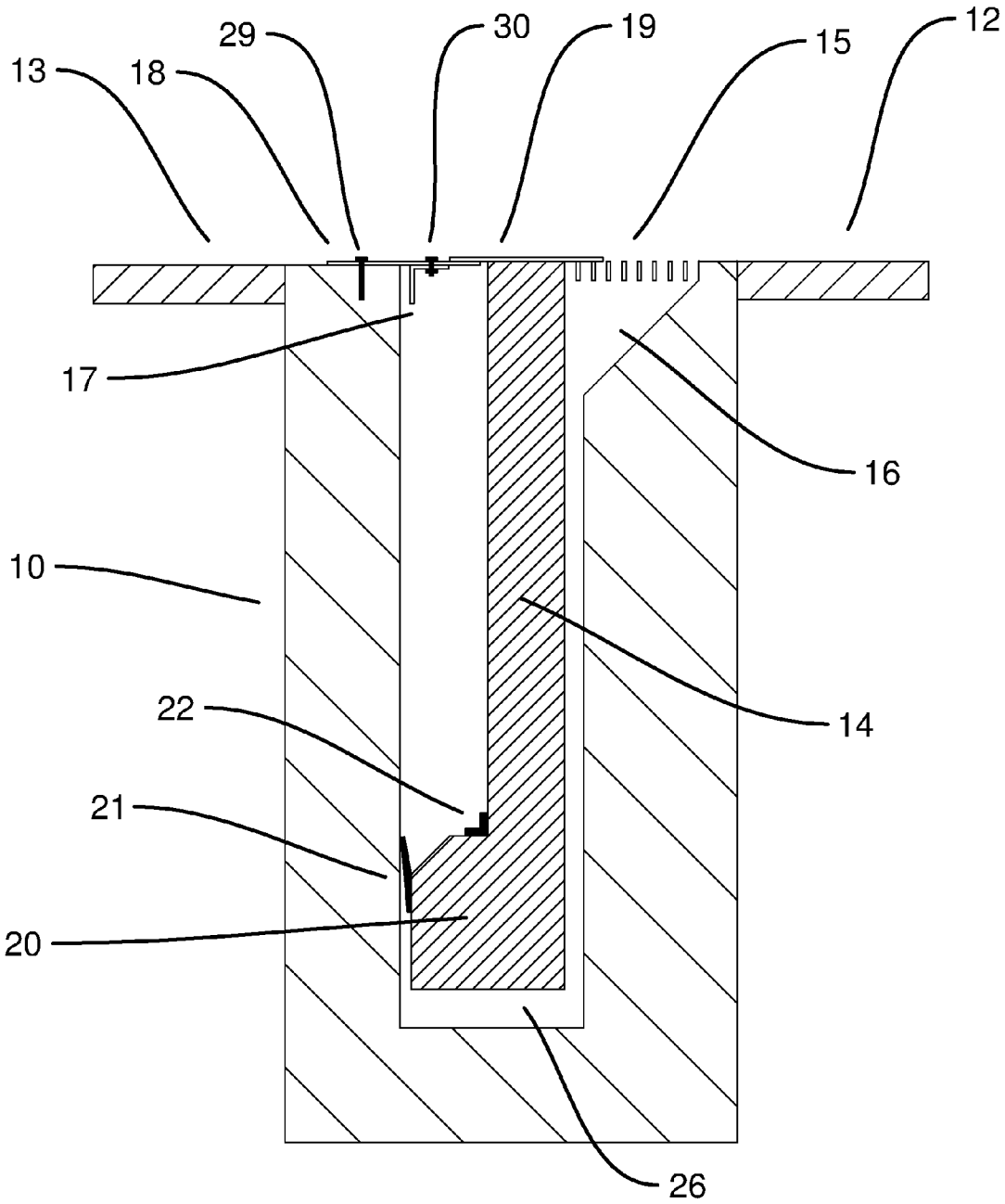
FIG. 3 depicts a cross section of the buoyant wall chamber in the open resting state.
Figure 4:
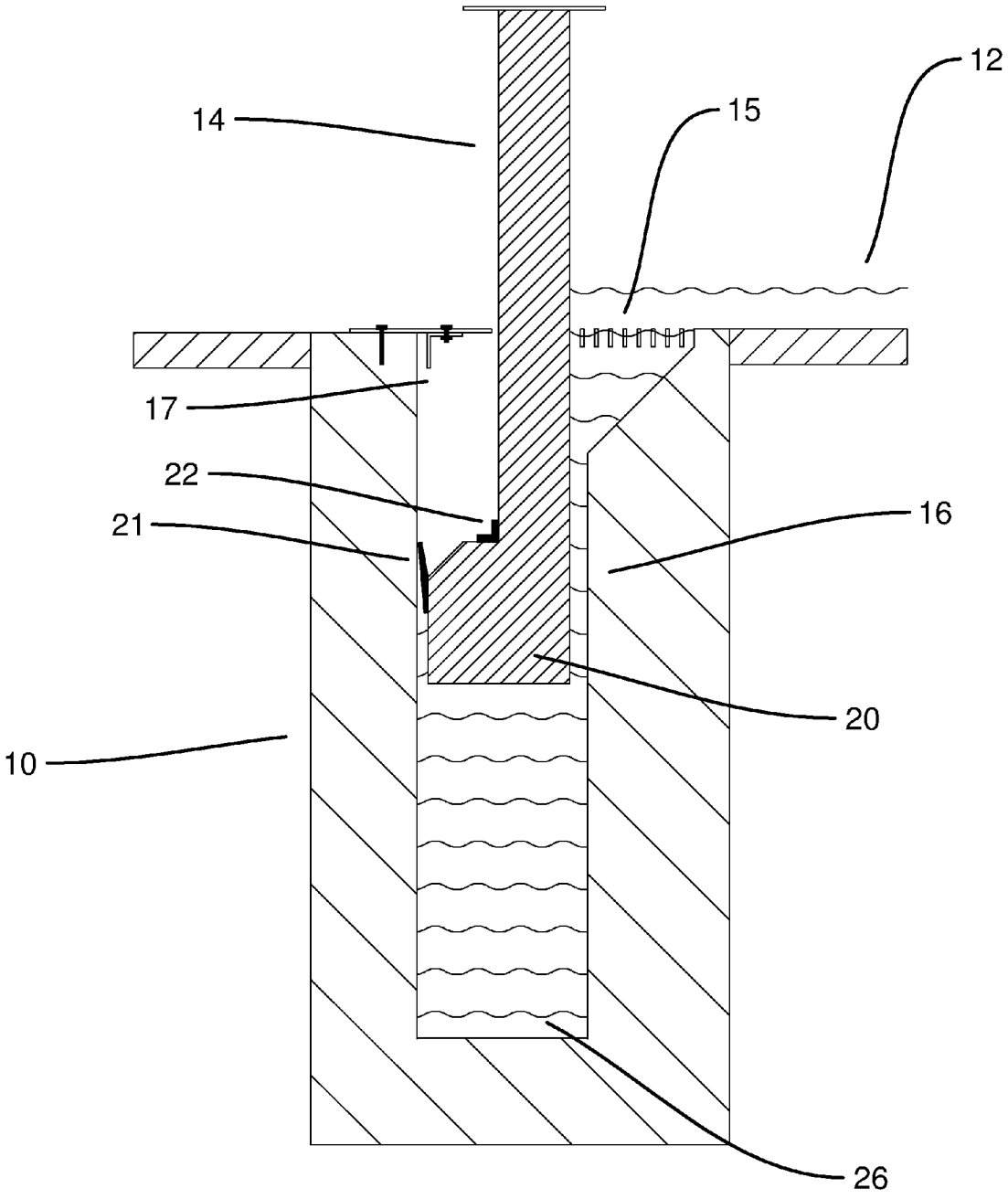
FIG. 4 depicts a cross section of the buoyant wall chamber in the partial open state.
Figure 5:
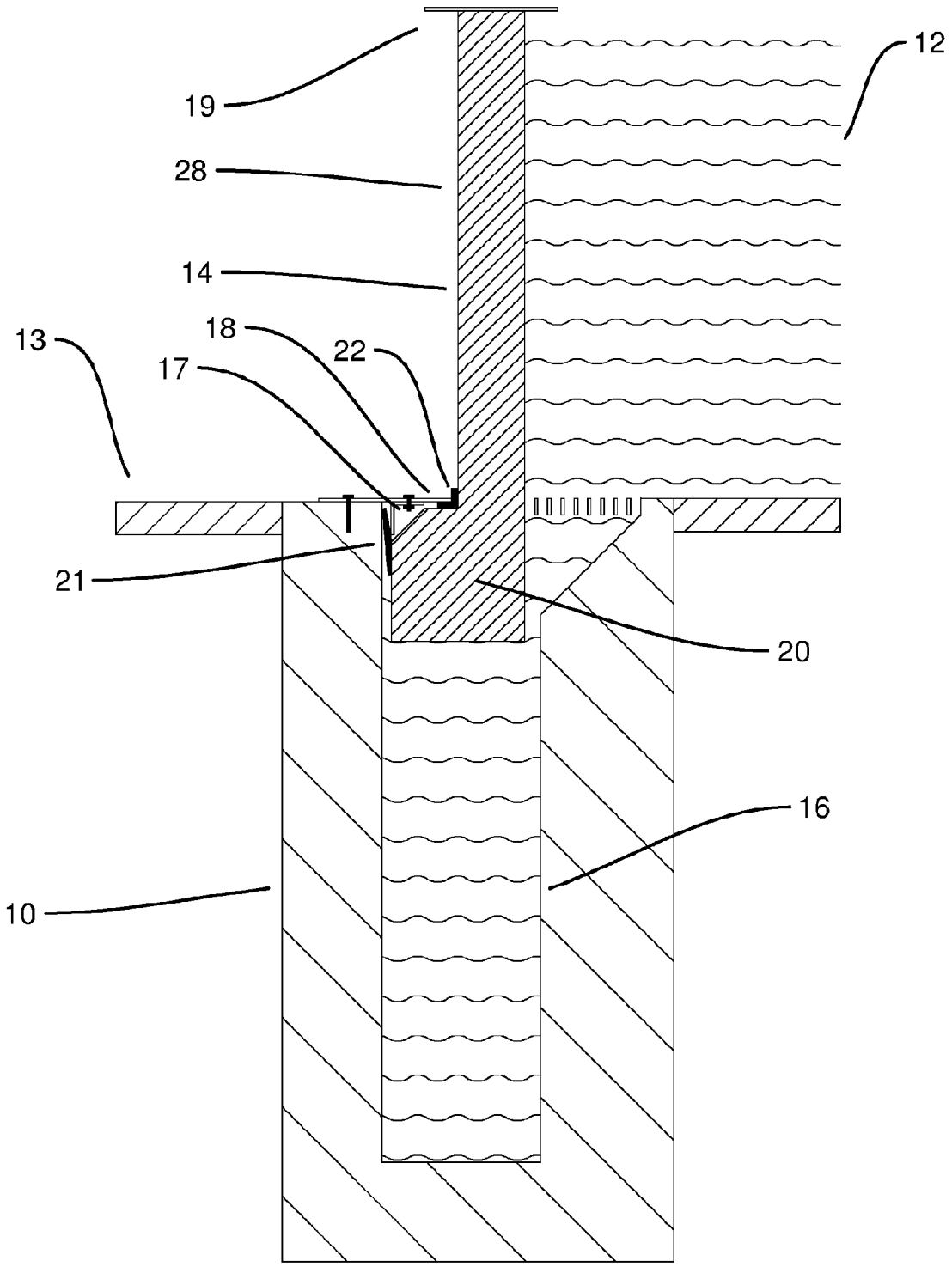
FIG. 5 depicts a cross section of the buoyant wall chamber in the closed state.
Figure 6:
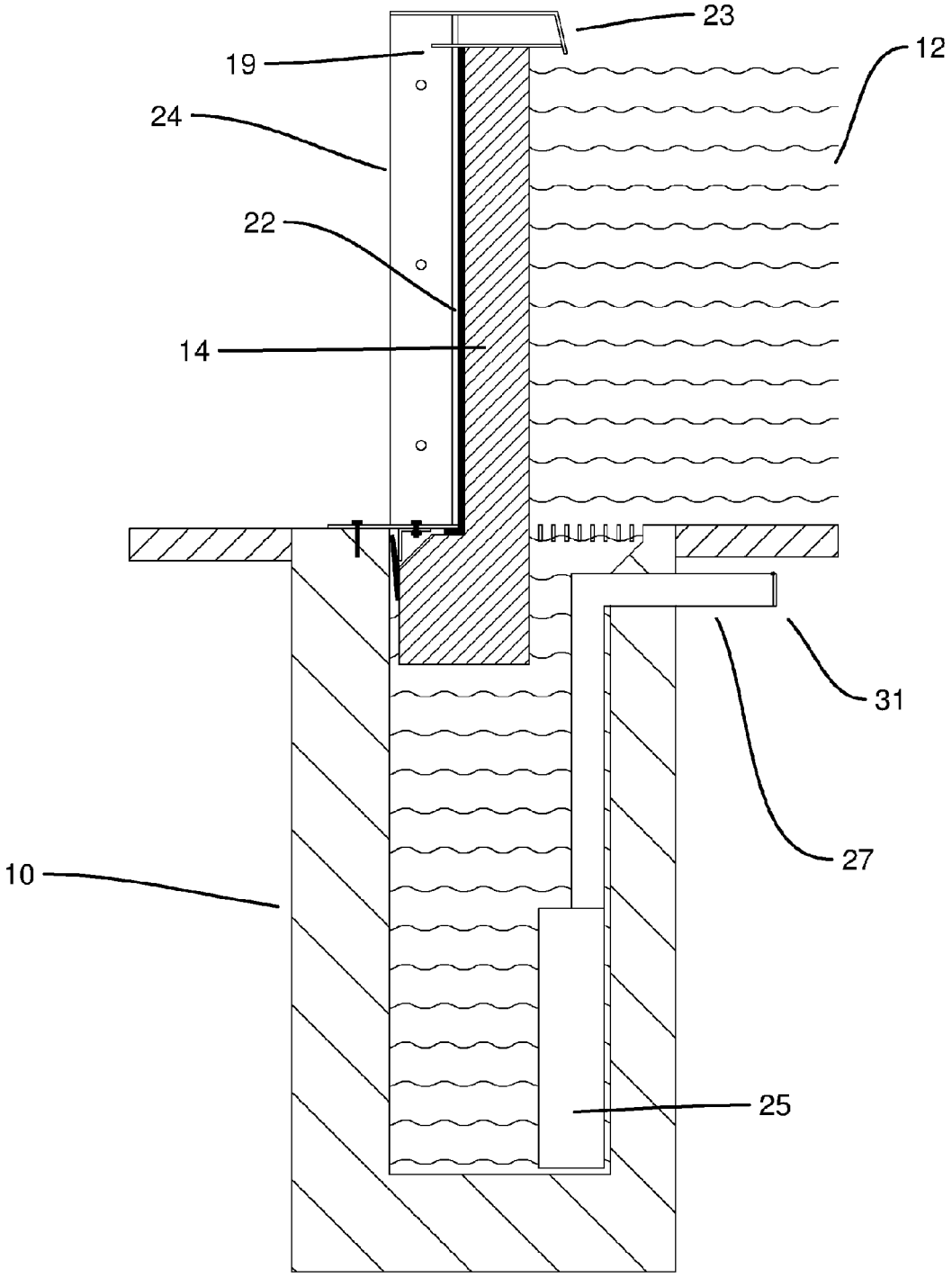
FIG. 6 depicts a cross section of the buoyant wall chamber in the closed state including boundary wall and pump isolated.
Figure 7:
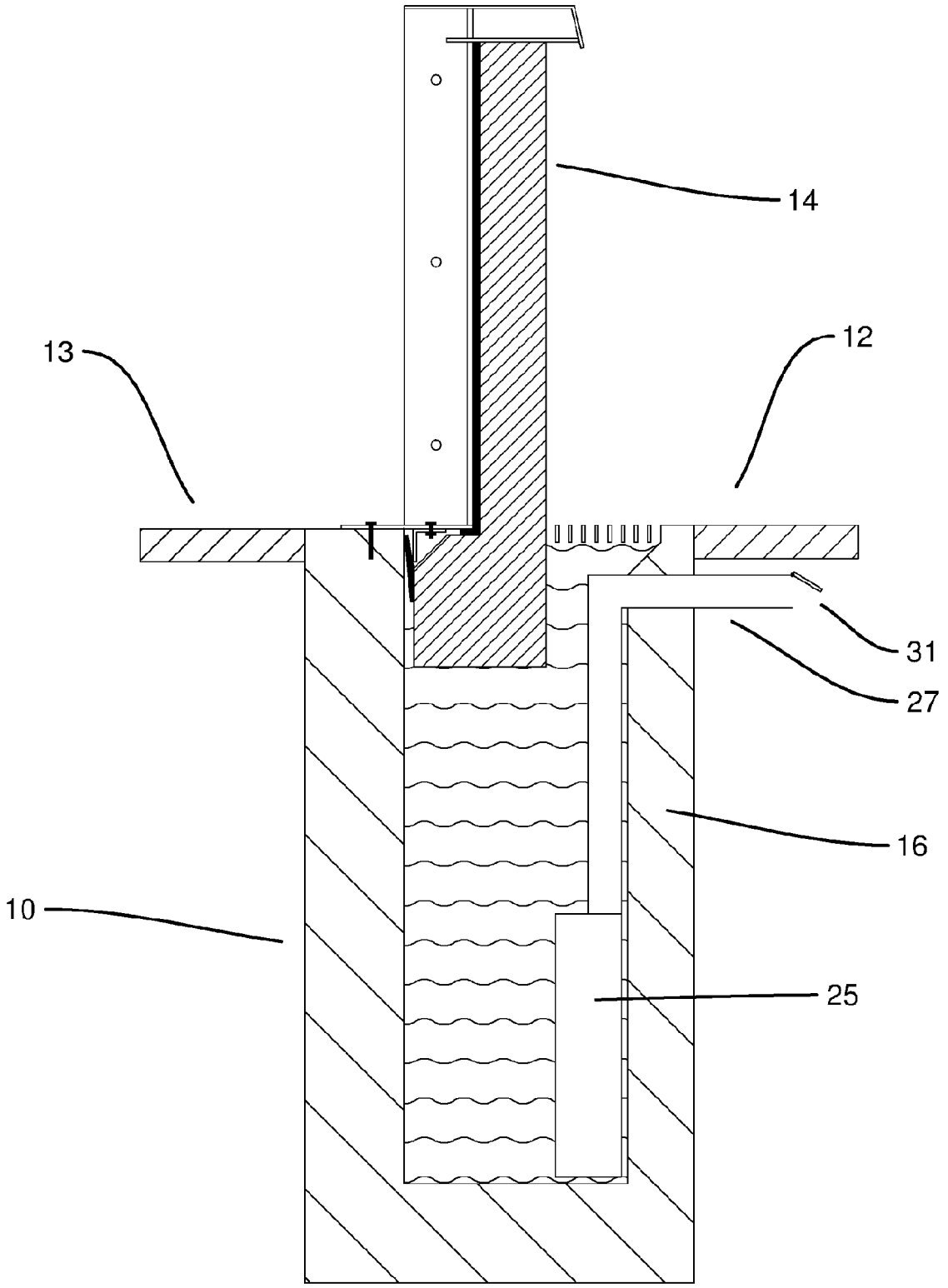
FIG. 7 depicts a cross section of the buoyant wall chamber in the closed state including boundary wall and pump in operation.
Figure 9:
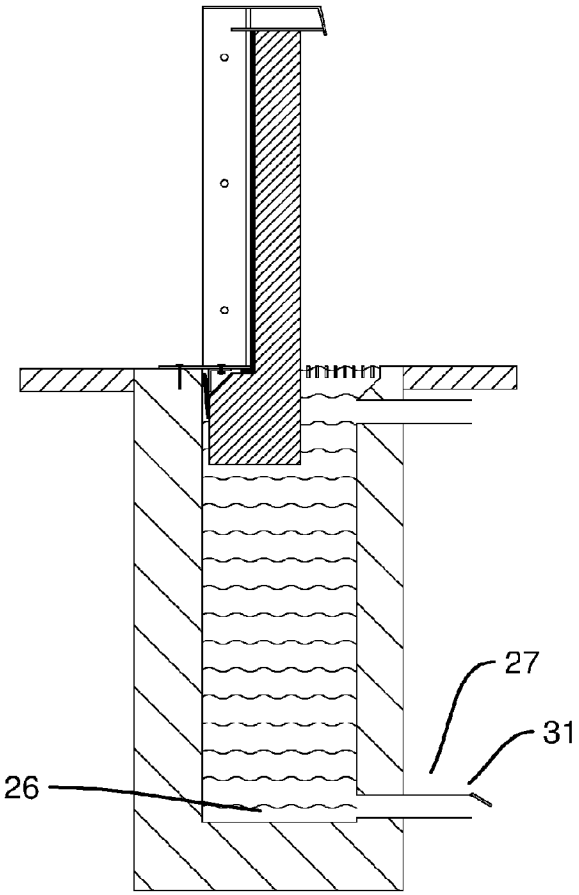
FIG. 9 depicts a cross section of the buoyant wall chamber in the closed state including boundary wall and gravity discharge in operation.
Figure 8:
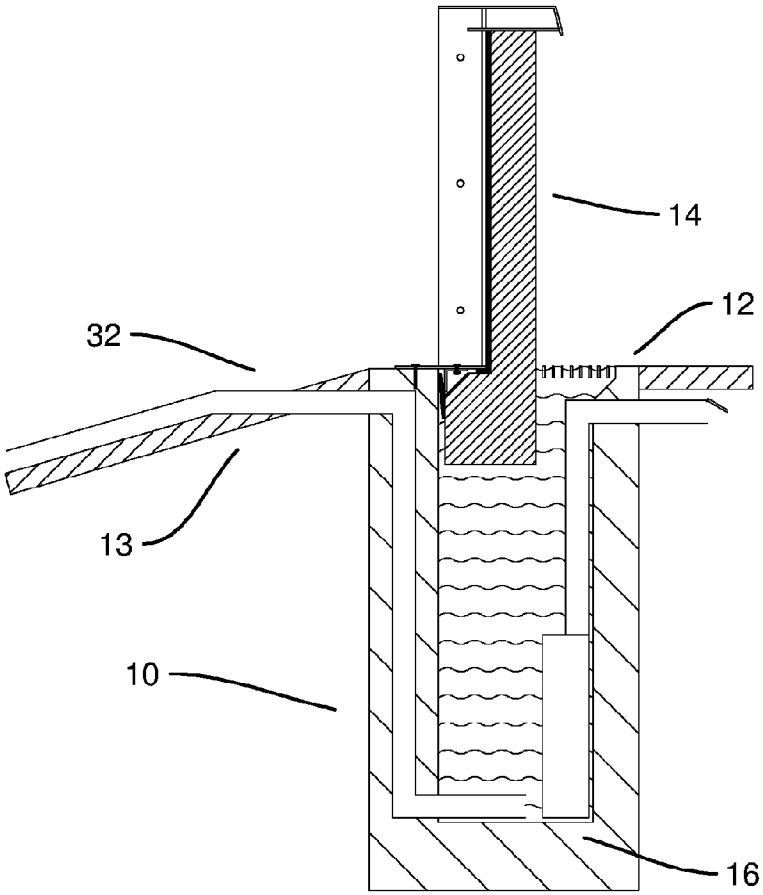
FIG. 8 depicts a cross section of the buoyant wall chamber in the closed state including boundary wall, pump and self-siphon in operation.
Figure 12:
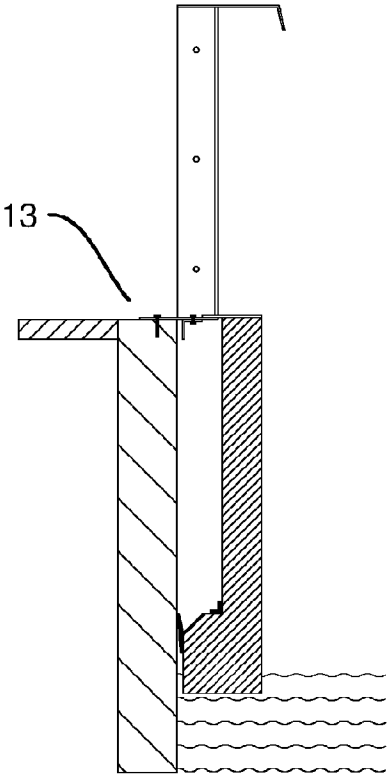
FIG. 12 depicts a cross section of the buoyant wall chamber in the open resting state including boundary wall and freestanding installation.
Figure 11:
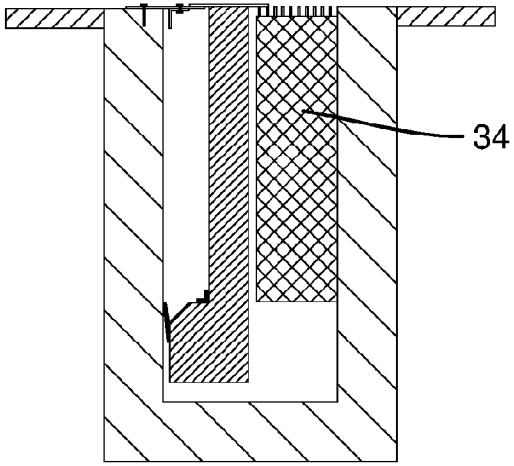
FIG. 11 depicts a cross section of the buoyant wall chamber in the open resting state with filtration basket.
Figure 10:
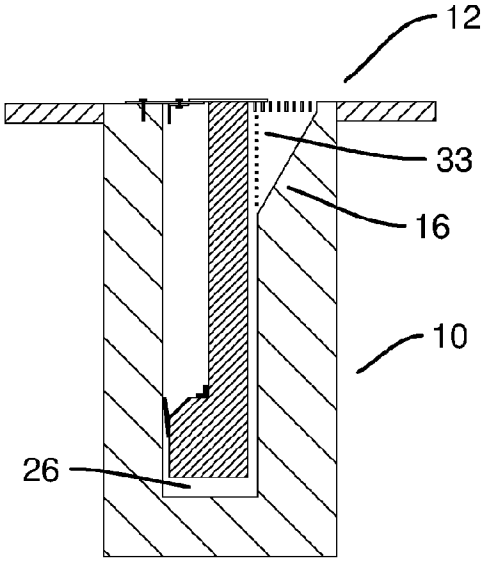
FIG. 10 depicts a cross section of the buoyant wall chamber in the open resting state with filtration screen.

It is preferable that the hydrostatic fluid containment system apparatus be constructed from 150 mm reinforced precast concrete fitted with lifting lugs to achieve uniform horizontal and vertical faces to enable the internal and external fabricated components of the device to be fitted to smooth surfaces of the chamber 16 and to allow for lifting, transportation and installation. Alternatively corrosion resistant steel treated metal, plastic or composite material could deliver a similar smooth surface for component precision.

Chamber 16 is preferably located between smooth boundary walls 11 to facilitate watertight joins between vertical guide wall frames 24 which should be constructed from 5 mm thick stainless steel angle extrusions to prevent stormwater passing between boundary walls 11 and buoyant wall 14 from reaching dry zone 13.

It is preferable that sealing rubber 22 be constructed from 25 mm diameter half round hollow rubber tube with a 25 mm flat continuous tag attached. The hollow tube allows for greater deformation and can seal along faces that may not be completely straight due to manufacturing or installation tolerances. The flat continuous tag facilitates a mounting compression join using flat bar that joins the sealing rubber 22 to buoyant wall 14. Pivot sealing guide 21 should be tapered at 10 degrees to allow for a smooth transition when compressing sealing rubber 22 and pivot seal 18.

Pivot seal guide 21 constructed from rigid material to prevent deformation and attached directly to vertical partitions 28 on buoyant wall 14 to enable a stable connection with limited joins between support beam 19 through to angled bracket seal 17. Pivot sealing guide 21 should have friction resistant material such at HDPE attached to the edge facing chamber 16 wall to prevent gouging. Angled bracket seal 17, pivot seal 18, support bean 19 and tension brackets constructed from 5 mm thick stainless steel extrusions. Angled bracket seal 17 should have elongated holes for fasteners 30 which allows calibration to obtain a watertight seal if manufacturing tolerances are not met during construction of buoyant wall 14.

Buoyant wall 14 should be constructed from closed cell foam laminated in 2 mm stainless steel metal sheet or hollow roto moulded polyethylene plastic for extra impact and corrosive resistance. Vertical partitions 28 should be 5 mm thick and 100 mm wide to provide sufficient rigidity and prevent deflection of buoyant wall 14.

Inlet grate 15 should withstand vehicular traffic and be removable for servicing and maintenance of chamber 16. Filtration screen 32 and basket 33 will be constructed from corrosion resistant material with aperture sizes of between 1.5 and 3 mm to prevent debris from interfering with the movement of buoyant wall 14 and the water sealing rubber 22.

It is preferable that in the current configuration, buoyant wall 14 is 100 mm wide while the buoyant wall base 20 is 200 mm wide and 200 mm deep to provide enough hydrostatic force to lift a 500 mm tall buoyant wall 14. A gap between collection sump 26 and buoyant wall base 20 is required to stop compressive forces from traffic above from deforming buoyant wall 14.

Float activated pump 25 should be submersible with 32 mm diameter discharge drains 27 for both pumped and siphon 32 pipes. It is preferable that float activated pump 25 has twin activation heights, initially when the collection sump 26 fluid level is just below the lifting displacement volume of buoyant wall base 20 and disengage when fluid levels are above ground surface level, then re-engage when fluid in the upstream catchment 12 subsides back to ground level. This operation will ensure buoyant wall 14 will remain below ground when small volumes of fluid enter chamber 16 and disengage pump from operating when the buoyant wall 14 is in the raised open position until upstream catchment 12 has subsided.

It will be appreciated by those skilled in the art, that the invention is not restricted in its use to the particular application described, nor is it restricted to the feature of the preferred embodiment described herein. It will be appreciated that various modifications can be made without departing from the principals of the invention, therefore, the invention should be understood to include all such modifications within its scope.

The invention claimed is:

1. A hydrostatic fluid containment system apparatus intercepts fluid flows at a predetermined location and raises a temporary buoyant wall to prevent floodwater or industrial spills upstream of the apparatus from causing damage to property or infrastructure downstream of said apparatus comprising:

boundary containment walls between which fluid flow can be intercepted, an inlet to allow fluid entry into a collection chamber, a buoyant wall that can move freely up and down within said collection chamber which retains fluid on the upstream side of said collection chamber, a buoyant wall base element that can be sized to provide equal and opposite displacement mass to lift said buoyant wall means of varying depths within said fluid, a pivot seal that enhances sealing due to pivot of said buoyant wall and retains said buoyant wall within said collection chamber, a pivot seal guide element which cooperates with a bracket or angle to locate said buoyant wall against said pivot seal, a sealing element between said pivot seal and said buoyant wall.

2. A hydrostatic fluid containment system apparatus according to claim 1 wherein said buoyant wall raises above ground by displacement from said fluid captured in said collection chamber to create a blockade which prevents the flow of said fluids on the upstream side of said inlet from reaching the downstream side of said apparatus.

3. A hydrostatic fluid containment system apparatus according to claim 1 wherein said buoyant wall base element pivots the top of said buoyant wall towards said inlet or upstream side from intercepted fluid hydrostatic forces acting beneath said buoyant wall base element.

4. A hydrostatic fluid containment system apparatus according to claim 3 wherein hydrostatic forces from retained fluids on the upstream side of said apparatus pivot said buoyant wall means away from said inlet or upstream side counteracting the forces acting beneath said buoyant wall base element.

5. A hydrostatic fluid containment system apparatus according to claim 1 wherein said pivot seal guide element is tapered to compress said sealing element between said pivot seal and said buoyant wall as hydrostatic forces act beneath said buoyant wall base element.

6. A hydrostatic fluid containment system apparatus according to claim 5 wherein said pivot seal guide element is forced against said sealing element and creates compressive forces on said sealing element due to its tapered shape as said buoyant wall means raises.

7. A hydrostatic fluid containment system apparatus according to claim 1 wherein said buoyant wall is forced against said pivot seal by hydrostatic forces on said buoyant wall base element and is locked into place by said pivot seal guide element against said sealing element preventing said buoyant wall from pivoting any further thereby supporting inlet flow forces.

8. A hydrostatic fluid containment system apparatus according to claim 6 wherein said sealing element comprises a bracket with an angle.

9. A hydrostatic fluid containment system apparatus according to claim 7 wherein hydrostatic upstream inlet forces are retained and supported by said buoyant wall that is temporarily locked into place.

10. A hydrostatic fluid containment system apparatus according to claim 1 wherein said buoyant wall is compressed against boundary wall guide frame due to said upstream hydrostatic fluid forces and clamped in position by tension bracket elements that prevent said buoyant wall means from releasing pressure on said sealing element during upstream wave movements that may cause negative forces on said buoyant wall.

11. A hydrostatic fluid containment system apparatus according to claim 1 wherein said buoyant wall is connected only to the downstream side of said apparatus.

12. A hydrostatic fluid containment system apparatus according to claim 1 wherein said pivot seals can be removed to providing access to said buoyant wall.

13. A hydrostatic fluid containment system apparatus according to claim 1 wherein said buoyant wall lowers into said chamber when contained upstream inlet fluid subsides and said chamber is drained.

14. A hydrostatic fluid containment system apparatus according to claim 1 wherein said collection chamber can be fitted with filter screens or filter baskets.

15. A hydrostatic fluid containment system apparatus according to claim 1 wherein said collection chamber can be drained by pump, siphon or gravity.

16. A hydrostatic fluid containment system apparatus according to claim 1 wherein hydrostatic forces acting below said buoyant wall and upstream of said buoyant wall counteract one another reducing total stress on said apparatus.

17. A hydrostatic fluid containment system apparatus according to claim 1 wherein said pivot seals provide a water tight join between said buoyant wall and said upstream inlet.

18. A hydrostatic fluid containment system apparatus according to claim 16 wherein said buoyant wall base element is mounted to the downstream side of said buoyant wall to create an unstable equilibrium centroid of displacement which pivots said buoyant wall towards said upstream inlet.

19. A hydrostatic fluid containment system apparatus according to claim 15 wherein a siphon is fitted with an air break element and isolation valve element to self-prime the discharge drain when removing said fluid from said collection chamber.

20. A hydrostatic fluid containment system apparatus according to claim 7 wherein partitioned buoyant walls create vertical support beams that lock into pivot seals and prevent deflection of said buoyant wall.

21. A hydrostatic fluid containment system apparatus according to claim 11 wherein said buoyant wall and pivot are mounted downstream of said collection chamber which facilitates room for upstream additions to be adapted to said apparatus.

22. A buoyant wall raised above a fluid collection chamber to a temporary position to prevent fluid flow, said buoyant wall held in the raised position by the fluid within the collection chamber and fluid flow beyond the buoyant wall prevented by a pivot seal, wherein the pivot seal enhances sealing due to pivot of said buoyant wall and retains said buoyant wall within the collection chamber, said buoyant wall comprising a sealing guide element which cooperates with an angle or bracket to locate said buoyant wall relative to said pivot seal.

* * * * *